US009509100B2

(12) United States Patent
Phillips et al.

(10) Patent No.: US 9,509,100 B2
(45) Date of Patent: Nov. 29, 2016

(54) ELECTRICAL CONNECTOR HAVING REDUCED CONTACT SPACING

(71) Applicant: Tyco Electronics Corporation, Berwyn, PA (US)

(72) Inventors: Michael John Phillips, Camp Hill, PA (US); Randall Robert Henry, Harrisburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 103 days.

(21) Appl. No.: 14/202,748

(22) Filed: Mar. 10, 2014

(65) Prior Publication Data

US 2015/0255929 A1 Sep. 10, 2015

(51) Int. Cl.

| | |
|---|---|
| ***H01R 4/58*** | (2006.01) |
| ***H01R 13/6587*** | (2011.01) |
| ***H01R 13/6471*** | (2011.01) |
| *H01R 12/58* | (2011.01) |
| *H01R 12/71* | (2011.01) |
| *H01R 12/72* | (2011.01) |
| *H01R 13/11* | (2006.01) |

(52) U.S. Cl.

CPC ..... *H01R 13/6587* (2013.01); *H01R 13/6471* (2013.01); *H01R 12/585* (2013.01); *H01R 12/716* (2013.01); *H01R 12/724* (2013.01); *H01R 13/112* (2013.01)

(58) Field of Classification Search

CPC H01R 13/6587; H01R 13/631; H01R 12/71; H01R 4/66; H01R 23/688; H01R 23/7073

USPC ..... 439/607.05–607.16, 541.5, 439/607.34–607.4, 608

See application file for complete search history.

(56) References Cited

U.S. PATENT DOCUMENTS

| | | | | |
|---|---|---|---|---|
| 6,146,202 | A | 11/2000 | Ramey et al. | |
| 6,174,202 | B1 | 1/2001 | Mitra | |
| 6,379,188 | B1 * | 4/2002 | Cohen | H01R 13/514 439/101 |
| 7,175,446 | B2 | 2/2007 | Bright et al. | |
| 7,422,483 | B2 | 9/2008 | Avery et al. | |
| 7,824,197 | B1 | 11/2010 | Westman et al. | |
| 7,988,491 | B2 | 8/2011 | Davis et al. | |
| 8,083,526 | B2 | 12/2011 | Long | |
| 8,328,565 | B2 * | 12/2012 | Westman | H01R 12/724 439/108 |
| 8,961,229 | B2 * | 2/2015 | Pan | 439/607.07 |
| 9,028,281 | B2 * | 5/2015 | Kirk | H01R 12/721 439/701 |
| 2012/0135615 | A1 * | 5/2012 | Mizukami et al. | 439/108 |
| 2013/0102192 | A1 | 4/2013 | Davis | |
| 2015/0079821 | A1 * | 3/2015 | Pao et al. | 439/108 |
| 2015/0140861 | A1 * | 5/2015 | Regnier et al. | 439/607.1 |

* cited by examiner

*Primary Examiner* — Amy Cohen Johnson
*Assistant Examiner* — Milagros Jeancharles

(57) ABSTRACT

An electrical connector includes a housing, signal modules, and ground plates. The signal modules and ground plates are arranged in a pattern that includes ground plates flanking corresponding pairs of signal modules within the housing. The signal modules have a dielectric body and signal conductors held within the dielectric body. The signal conductors include contact beams protruding from a front edge for electrical termination. Each ground plate has contact beams aligned with the contact beams of the signal modules to provide shielding therebetween. Each signal module has a lateral thickness that is greater than a thickness of each ground plate. The signal conductors of each signal module are offset relative to a central plane of the signal module such that contact spacings between adjacent contact beams are uniform. Optionally, ground tie bars extend through the signal modules and ground plates to electrically common the ground plates.

20 Claims, 5 Drawing Sheets

ELECTRICAL CONNECTOR HAVING REDUCED CONTACT SPACING

BACKGROUND OF THE INVENTION

The subject matter described herein relates to electrical connectors that mate with pluggable modules having circuit boards.

Some electrical connectors include a socket that receives a mating edge of a circuit board within a pluggable module. The mating edge provides an interface between the pluggable module and one or more rows of electrical contacts that extend within the socket of the electrical connector. The circuit board includes contact pads arranged along the mating edge on one or both opposite sides of the circuit board. The electrical connector includes a pair of opposite rows of electrical contacts extending within the socket that engage the contact pads on corresponding sides of the circuit board. The electrical contacts are signal contacts and ground contacts. The signal contacts convey differential signals, while the ground contacts provide shielding and grounding to the transmitted signals.

The ongoing trend of smaller connectors transmitting more data and operating at faster data rates leads to continuing increases in the density of the signal contacts. The density of signal contacts may be increased by reducing the spacing between adjacent contacts. Reducing the spacing presents mechanical design issues and electrical operating issues. For example, in some electrical connectors the signal conductors are over-molded with a dielectric material to provide electrical insulation and support to the signal conductors. Reducing the spacing between contacts may require reducing the amount of over-molded dielectric material around the signal conductors, which increases the difficulty of over-molding the signal conductors, reduces the insulating ability of the dielectric material, and/or reduces the structural support of the signal conductors provided by the dielectric material.

As the spacing between adjacent contacts is reduced, electrical interference and cross-talk produced between the contacts may increase, which reduces the speed and operating efficiency of the connector. There is also less available space for ground contacts or shields between signal connectors to reduce the interference and cross-talk. In addition, reducing the spacing between contacts may risk two adjacent contacts touching each other, such as when loading the circuit board in the socket, which could cause a short. Furthermore, reducing the spacing affects the impedance of the connector, and impedance generally must be tuned to match the operating environment.

BRIEF DESCRIPTION OF THE INVENTION

In an embodiment, an electrical connector is provided that includes a housing, a plurality of signal modules, and a plurality of ground plates. The signal modules are within the housing. The signal modules each have a dielectric body and signal conductors held within the dielectric body. The signal conductors include contact beams protruding from a front edge of the dielectric body for electrical termination. The ground plates are within the housing and are arranged in a pattern with the signal modules. The pattern includes ground plates flanking corresponding pairs of the signal modules. Each ground plate has contact beams laterally aligned with the contact beams of the signal modules to provide shielding therebetween. Each signal module has a lateral thickness that is greater than a thickness of each ground plate. The signal conductors of each signal module are offset relative to a central plane of the signal module such that contact spacings between laterally adjacent contact beams are uniform.

In an embodiment, an electrical connector is provided that includes a housing and a plurality of signal modules and ground plates. The housing has a front wall and at least one mating interface extending forward from the front wall. The mating interface includes a port at a distal end open to a mating cavity. The mating cavity configured to receive an edge of a mating circuit board of a pluggable module. The mating circuit board is loaded through the port when the pluggable module mates with the mating interface. The signal modules and ground plates are disposed in a module stack within the housing. The module stack includes a pattern of ground plates flanking corresponding pairs of signal modules. Each signal module and ground plate includes respective contact beams extending from a front edge of the module stack. The contact beams of the signal modules and the ground plates are laterally aligned across a width of the module stack in rows. The rows of contact beams are disposed within the mating cavity for electrical connection to the mating circuit board. The housing further includes divider walls that extend between laterally adjacent contact beams to separate the contact beams. The divider walls extend less than a total length of the contact beams such that air gaps are defined between the front edge of the module stack and a rear of the divider walls.

Optionally, the contact beams may each have a deflectable arm that extends to a mating tip at a distal end of the contact beam. The divider walls may be positioned between corresponding mating tips of laterally adjacent contact beams, and the air gaps may be positioned between corresponding deflectable anus of the laterally adjacent contact beams. A length of the air gaps between the front edge of the module stack and the rear of the divider walls may be selected to tune the signal conductors to a target impedance. Optionally, the port and the mating cavity of the mating interface may have a width greater than the stack width. The housing may include at least one guide rail within the mating cavity between the module stack and an interior side wall of the mating interface. The at least one guide rail may be configured to guide the mating circuit board of the pluggable module into the mating cavity. Optionally, the signal conductors of each signal module may form a contact plane within the dielectric body, and ground tie bars may extend transversely through defined slots in the signal module across the contact plane.

DETAILED DESCRIPTION OF THE INVENTION

Embodiments set forth herein include connector assemblies that have electrical connectors and pluggable modules. The electrical connectors may be configured with a reduced contact spacing between adjacent contacts to provide a greater contact density within a defined contact area. Although the contact spacing is reduced, the electrical connectors set forth herein may have housings and/or contact modules configured to provide electrical shielding and insulation to prohibit signal degradation and to provide a target impedance for electrical signals transmitted therethrough.

Figure 1:
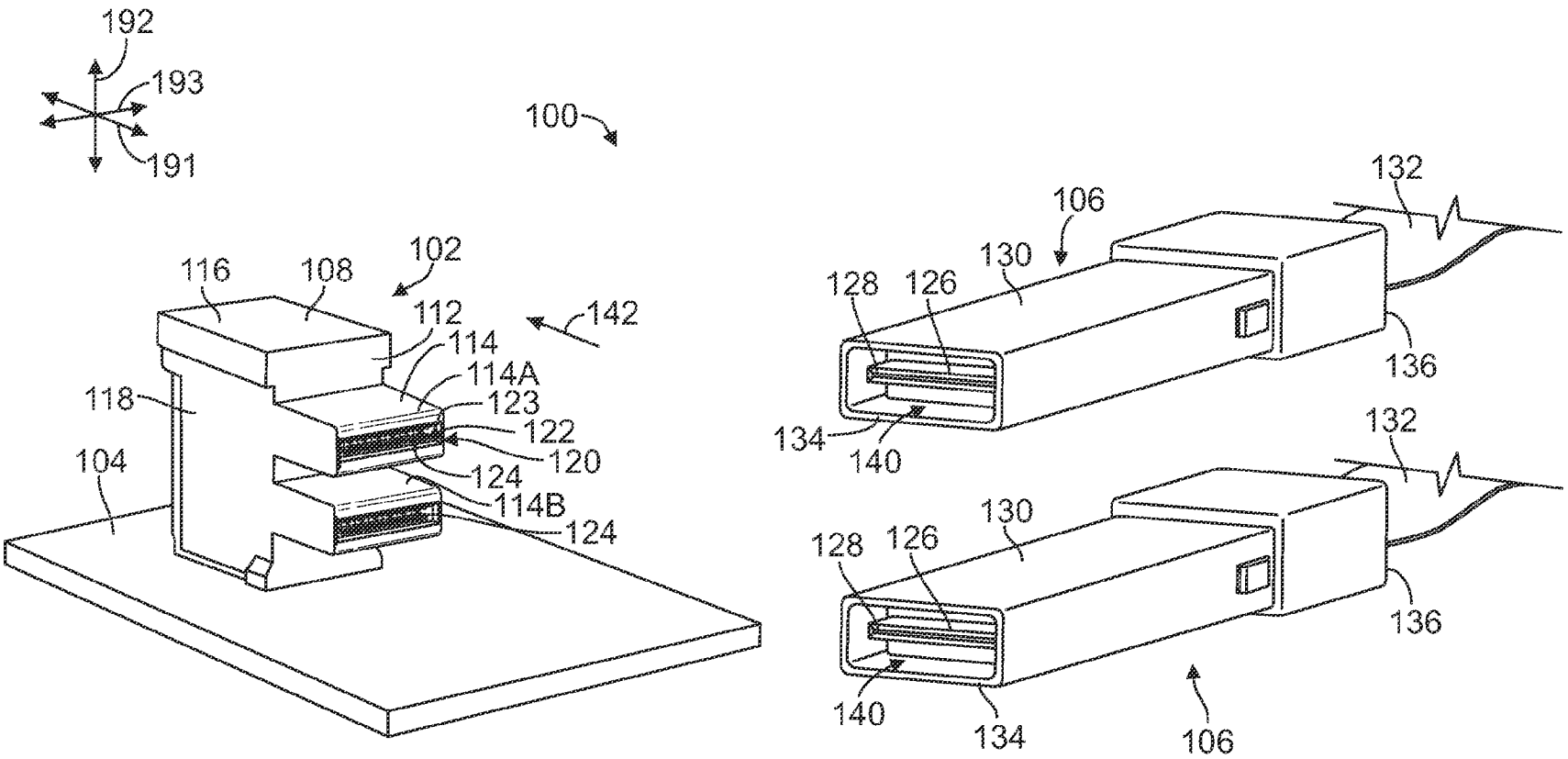
FIG. 1 is a perspective view of a connector assembly in accordance with an exemplary embodiment.

FIG. 1 is a perspective view of a connector assembly 100 in accordance with an exemplary embodiment. The connector assembly 100 includes an electrical connector 102 that is mounted on a host circuit board 104. The connector assembly 100 further includes two pluggable modules 106 that are configured to mate with the electrical connector 102 to electrically connect the pluggable modules 106 to the electrical connector 102. Signals are conveyed between the pluggable modules 106 and the circuit board 104 through the electrical connector 102. Although two pluggable modules 106 are shown and described in FIG. 1, in alternative embodiments, the electrical connector 102 may simultaneously engage more or less than two pluggable modules 106.

The connector assembly 100 may be part of or used with telecommunication systems or devices. For example, the connector assembly 100 may be part of or include a switch, router, server, hub, network interface card, personal computer, or storage system. The circuit board 104 may be a daughter card or a mother board and include conductive traces (not shown) extending therethrough. As used herein, the term "circuit board" refers to an electrical circuit in which the conductors have been printed or otherwise deposited in predetermined patterns on an insulating substrate. The connector assembly 100 may be disposed at least partially within a communication box or case (not shown) of the telecommunication system or device. The connector assembly 100 is oriented with respect to a mating or insertion axis 191, an elevation axis 192, and a lateral axis 193. The axes 191-193 are mutually perpendicular with respect to one another. Although the elevation axis 192 appears to extend in a vertical direction parallel to gravity in FIG. 1, it is understood that the axes 191-193 are not required to have any particular orientation with respect to gravity.

The electrical connector 102 may be an input/output electrical connector. The electrical connector 102 has a connector housing 108 and signal modules 204 (shown in FIG. 2) and ground plates 206 (FIG. 2) within the housing 108. The housing 108 at least partially surrounds and houses the signal modules 204 and ground plates 206. The connector housing 108 may be formed of a dielectric material, such as one or more plastics or other polymers. The housing 108 has a front wall 112 and at least one mating interface 114 extending forward from the front wall 112. In the illustrated embodiment, the housing 108 includes first and second mating interfaces 114A, 114B, respectively. The first mating interface 114A is stacked over the second mating interface 114B along the elevation axis 192 such that the second mating interface 114B is positioned between the first mating interface 114A and the circuit board 104. The electrical connector 102 may include other than two mating interfaces 114 and/or other relative arrangements of mating interfaces 114 in other embodiments. The housing 108 may include one or more other walls joined to the front wall 112 to define a module cavity (not shown) that receives the signal modules 204 and ground plates 206. For example, the housing 108 may have a top wall 116, opposing side walls 118, and/or a back wall (not shown) that is opposite the front wall 112. Optionally, the bottom of the connector 102 may be open to allow the signal modules 204 and ground plates 206 to mount and electrically connect to the circuit board 104. As used herein, relative or spatial terms such as "front," "back," "top," "bottom," "upper," "lower," "left," and "right" are only used to distinguish the referenced elements and do not necessarily require particular positions or orientations in the connector assembly 100 or in the surrounding environment of the connector assembly 100.

The at least one mating interface 114 includes a port or opening 120 at a distal end 123. The port 120 is open to a mating cavity 122 within the mating interface 114. The mating cavity 122 receives a plurality of electrical contacts 124 of the signal modules 204 (shown in FIG. 2) and ground plates 206 (FIG. 2) upon loading the signal modules 204 and ground plates 206 into the connector housing 108. The electrical contacts 124 may be contact beams that are configured to electrically connect to an internal circuit board 126 of a mating pluggable module 106. The electrical contacts 124 may be referred to herein as contact beams 124. The port 120 is sized and shaped to receive the internal circuit board 126 therethrough. For example, an edge 128 of the internal circuit board 126 is loaded through the port 120 of the mating interface 114 when the pluggable module 106 mates with the mating interface 114. The edge 128 of the circuit board 126 is received within the mating cavity 122, where conductors on the circuit board 126 electrically connect to the contact beams 124 of the electrical connector 102.

Each pluggable module 106 has a shell 130 and is connected to a cable 132. The shell 130 extends from a mating end 134 to an opposite cable end 136. The shell 130 houses and at least partially surrounds the internal circuit board 126. The cable 132 is coupled to the cable end 136 of the shell 130. In an embodiment, the cable 132 may be directly attached to the internal circuit board 126 within the shell 130. In an alternative embodiment, the pluggable module 106 may have a receptacle (not shown) at the cable end 136 that receives a plug connector (not shown) at a distal end of the cable 132 to allow for selective mating between different modules and cables. The shell 130 may be formed of an electrically conductive material, such as metal, that provides electrical shielding for signals transmitted through the module 106. Alternatively, the shell 130 may be formed of a dielectric material, such as a plastic or other polymer. The internal circuit board 126 is electrically coupled to wires (not shown) that extend through the cable 132 for termination. In alternative embodiments, the cable 132 may include optical fibers (not shown) instead of, or in addition to, electrical wires. The edge 128 of the internal circuit board 126 is disposed within a socket 140 at the mating end 134. The socket 140 is configured to receive therein a corresponding mating interface 114 of the electrical connector 102 when the pluggable module 106 mates to the electrical connector 102. To mate with the electrical connector 102, the pluggable module 106 is advanced along the mating axis 191 in a mating direction 142 towards the mating interface 114. The internal circuit board 126 may include contact pads 138 (shown in FIG. 2) at or proximate to the edge 128 of the circuit board 126 that electrically connect to the electrical contacts 124 within the mating cavity 122 when the pluggable module 106 is mated to the electrical connector 102.

The pluggable modules 106 may be input/output (I/O) transceivers configured to transmit data signals in the form of electrical signals and/or optical signals. In an embodiment, each pluggable module 106 may transmit electrical data signals and/or power. In another embodiment, each pluggable module 106 may be configured to convert data signals from optical signals to electrical signals or vice-versa. The pluggable module 106 may be a small form-factor pluggable (SFP) transceiver or quad small form-factor pluggable (QSFP) transceiver. The pluggable module 106 may satisfy certain technical specifications for SFP or QSFP transceivers, such as Small-Form Factor (SFF)-8431. In some embodiments, the pluggable module 106 is configured to transmit data signals up to 2.5 gigabits per second (Gbps), up to 5.0 Gbps, up to 10.0 Gbps, or more to and/or from the electrical connector 102.

Figure 2:
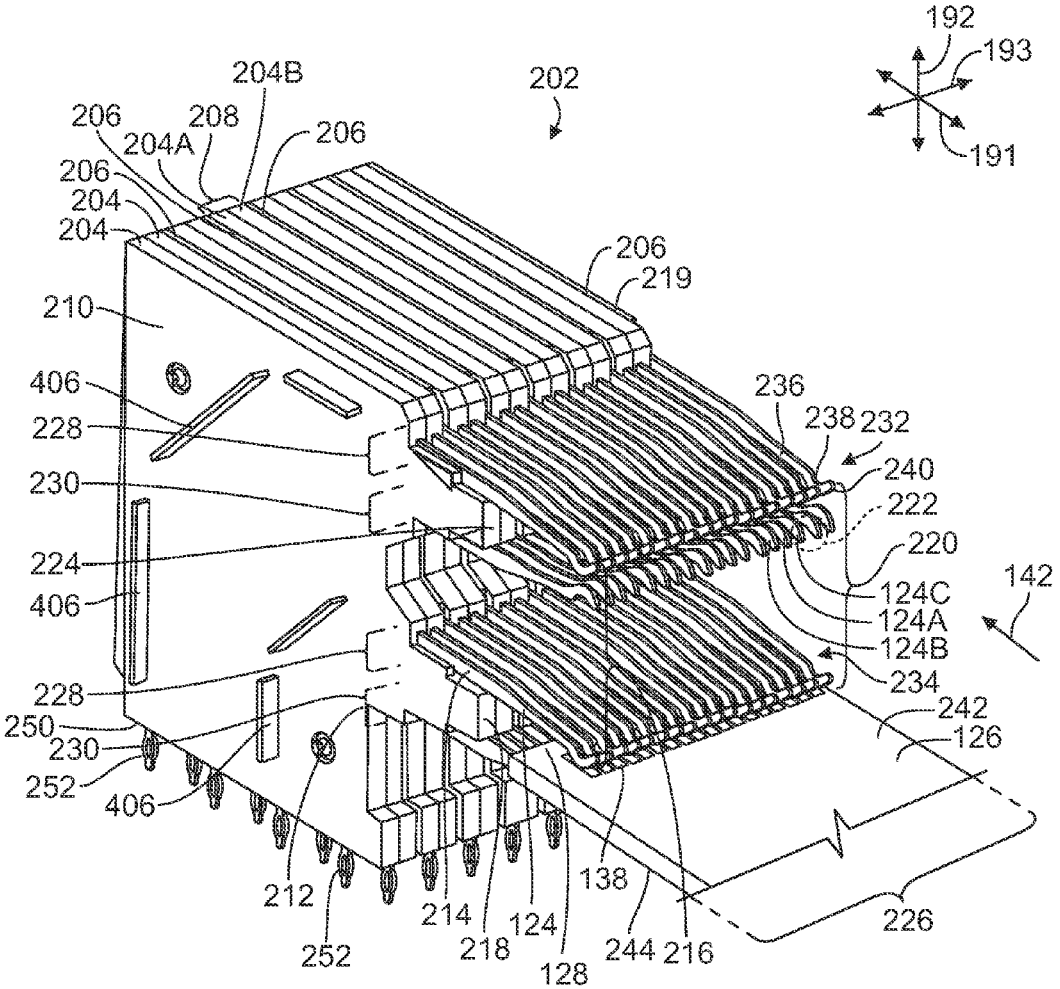
FIG. 2 is a perspective view of a module stack of an electrical connector in accordance with an embodiment.

FIG. 2 is a perspective view of a module stack 202 of the electrical connector 102 (shown in FIG. 1) in accordance with an embodiment. The module stack 202 may include the components of the electrical connector 102 other than the connector housing 108 (shown in FIG. 1). The module stack 202 includes a plurality of signal modules 204 and ground plates 206 stacked side-by-side along the lateral axis 193. The ground plates 206 are arranged in a pattern with the signal modules 204 that includes ground plates 206 flanking corresponding pairs 208 of the signal modules 204. As such, the ground plates 206 and signal modules 204 are arranged in a repeating ground-signal-signal-ground-signal-signal sequence with two adjacent signal modules 204 sandwiched between individual ground plates 206. In an embodiment, the pairs 208 of two signal modules 204 form a differential pair carrying differential signals. Each pair 208 of signal modules 204 includes a left signal module 204A and a right signal module 204B. The left and right signal modules 204A, 204B are abutted against each other. A corresponding ground plate 206 abuts against an outer side 210 of the respective left and right signal modules 204A, 204B of the pair 208. As such, the ground plates 206 are disposed between adjacent pairs 208 of signal modules 204.

The signal modules 204 each have a dielectric body 212 and signal conductors 214 held within the dielectric body 212. For example, the signal conductors 214 may be over-molded with a dielectric material to form the dielectric body 212. The signal conductors 214 include contact beams 124. The contact beams 124 of each signal module 204 may be oriented in a column 216 that extends along the elevation axis 192. The column 216 of contact beams 124 protrude from a front edge 218 of the dielectric body 212 for electrical termination to a corresponding internal circuit board 126 of a pluggable module 106 (shown in FIG. 1). In an embodiment, each signal module 204 includes four contact beams 124 in the column 216. The contact beams 124 of adjacent signal modules 204 in each pair 208 may be aligned to form a differential pair 222 to convey differential signals.

In an embodiment, the ground plates 206 have a conductive body 219 that is not over-molded or otherwise encapsulated with a dielectric material. The ground plates 206 are thinner than the signal modules 204 to facilitate tighter packaging of the signal modules 204 and ground plates 206 in the module stack 202. The ground plates 206 each include contact beams 124 extending forward along the mating axis 191 from the conductive body 219 and oriented in a column 220 along the elevation axis 192. The column 220 may be parallel to the column 216 of contact beams 124 of the signal modules 204. The contact beams 124 of the ground plates 206 may be aligned with the contact beams 124 of the signal modules 204 to provide shielding therebetween. For example, a ground contact beam 124A disposed between a first signal contact beam 124B of one signal module pair 208 and a second signal contact beam 124C of an adjacent signal module pair 208 is laterally aligned with the signal contact beams 124B, 124C to provide electrical shielding and reduce crosstalk between the signal contact beams 124B, 124C of adjacent pairs 208 of signal modules 204.

The contact beams 124 of the signal modules 204 and ground plates 206 in the module stack 202 extend forward along the mating axis 191 from a front edge 224 of the module stack 202. The contact beams 124 are aligned across a width 226 of the module stack 202 in lateral rows that extend along the lateral axis 193. For example, the module stack 202 may include at least one upper row 228 and at least one lower row 230. The rows 228, 230 of contact beams 124 are received and housed within the mating cavity 122 (shown in FIG. 1) for electrical connection to the internal circuit board 126 of a corresponding pluggable module 106 (shown in FIG. 1). For example, the mating cavity 122 of each mating interface 114 (shown in FIG. 1) may be configured to receive a set of one upper row 228 and one lower row 230 of contact beams 124 therein. The electrical connector 102 (shown in FIG. 1) includes two stacked mating interfaces 114, so the module stack 202 includes a first set 232 of contact beams 124 configured to be housed within the first mating interface 114A (shown in FIG. 1) and a second set 234 of contact beams 124 configured to be housed within the second mating interface 114B (shown in FIG. 1) below the first mating interface 114A.

In an embodiment, each contact beam 124 includes a deflectable arm 236 that extends to a mating tip 238 at a distal or frontal end 240 of the contact beam 124. The edge 128 of the internal circuit board 126 of the corresponding pluggable module 106 (shown in FIG. 1) is received between the upper row 228 and the lower row 230 as the circuit board 126 is loaded in the mating direction 142. For example, an upper surface 242 of the circuit board 126 engages the mating tips 238 of the contact beams 124 in the upper row 228, and a lower surface 244 of the circuit board 126 engages the mating tips 238 of the contact beams 124 in the lower row 230. Each surface 242, 244 may include a plurality of contact pads 138 that electrically engage and connect to respective individual contact beams 124. The contacts 124 in the upper row 228 may deflect at least slightly upward, and the contacts 124 in the lower row 230 may deflect at least slightly downward when the edge 128 of the circuit board 126 is disposed between the rows 228, 230. The deflectable arms 236 may be biased towards an undeflected position, such that the deflectable arms 236 provide a mating force that retains the mating tips 238 in physical contact with the corresponding surface 242, 244 of the circuit board 126. The mating tips 238 optionally may be curved away from the corresponding surface 242, 244 of the circuit board 126 in order to reduce friction and/or damage during loading and unloading operations.

The module stack 202 further includes a mounting edge 250 that interfaces with the host circuit board 104 (shown in FIG. 1). The mounting edge 250 may be substantially flat. In an embodiment, the mounting edge 250 may be adjacent to the front edge 224. Each of the signal conductors 214 (for example, the mating ends of which are the contact beams 124), is configured to be electrically terminated to the host circuit board 104 via a mounting contact 252 that extends downward (for example, towards the circuit board 104) along the elevation axis 192 from the mounting edge 250. The mounting contacts 252 may be pin contacts, such as compliant eye-of-the-needle-type contacts, to facilitate press-fit termination of the electrical connector 102 (shown in FIG. 1) to the host circuit board 104 via thru-hole mounting, as shown. The mating contacts 252 may be terminated by other methods in alternative embodiments, such as via soldering to contact pads (not shown) of the circuit board 104.

Figure 3:
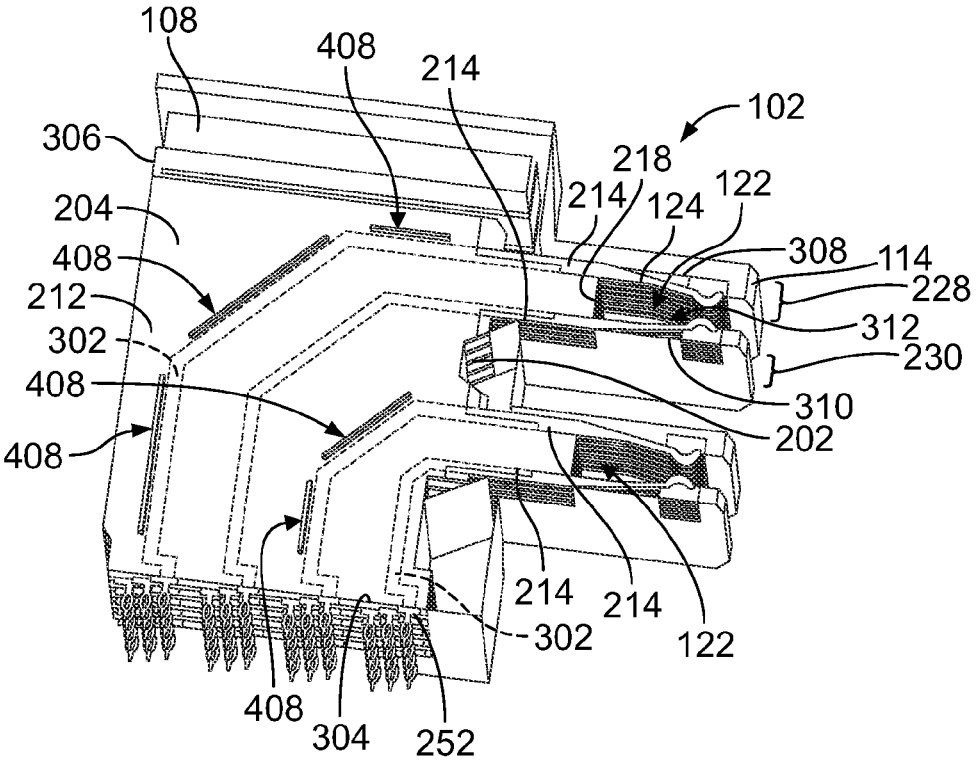
FIG. 3 is a cross-section of an electrical connector in accordance with an embodiment.

FIG. 3 is a cross-section of the electrical connector 102 in accordance with an embodiment. The cross-sectional view in FIG. 3 shows a side-view of one signal module 204 of the module stack 202. The signal module 204 includes multiple signal conductors 214. The signal conductors 214 may be formed from a lead frame. Each signal conductor 214 includes the contact beam 124, the mounting pin contact 252, and a transition portion 302 that mechanically and electrically connects the contact beam 124 to the mounting pin contact 252. The signal conductors 214 of each signal module 204 may be over-molded in the dielectric body 212 such that the transition portions 302 are encapsulated within the dielectric body 212 while the contact beams 124 and the mounting pins 252 extend from the front or mating edge 218 and a mounting edge 304, respectively. The mounting edge 304 of the signal module 204 may form at least part of the mounting edge 250 (shown in FIG. 2) of the module stack 202 when arranged with other signal modules 204 and ground plates 206 (shown in FIG. 2). In an embodiment, the signal conductors 214 within each signal module 204 are planar and form a contact plane within the dielectric body 212. The dielectric body 212 may be composed of one or more plastics or other polymers. Optionally, the dielectric body 212 may be molded around the signal conductors 214 to form the signal module 204. The signal conductors 214 are a conductive material, such as metal. Optionally, the signal conductors 214 may be stamped and formed from a sheet of metal.

In an embodiment, the signal module 204 may be loaded into the connector housing 108 through a rear 306 of the housing 108. Optionally, the signal module 204 may be loaded into the housing 108 individually or in a group as part of the module stack 202. The contact beams 124 of the signal module 204 extend into the mating cavity 122 of each mating interface 114. In FIG. 3, the signal module 204 includes four signal conductors 214 in order to provide two sets of upper and lower contact beams 124, where each set is received within one of the mating cavities 122. For example, the signal module 204 may include two upper contact beams 124 that form part of upper contact rows 228 and two lower contact beams 124 that form part of lower contact rows 230. In an embodiment, each upper row 228 of contact beams 124 is disposed along an upper interior wall 308 of the corresponding mating interface 114. Likewise, each lower row 230 is disposed along a lower interior wall 310 of the corresponding mating interface 114. The upper and lower interior walls 308, 310 define the top and bottom of the mating cavities 122, respectively. Since the contact beams 124 are disposed along the upper and lower interior walls 308, 310, a channel 312 is formed within the mating cavity 122 between the opposing upper and lower rows 228, 230 of contact beams 124. The internal circuit board 126 (shown in FIG. 2) is configured to be loaded within the channel 312.

Figure 4:
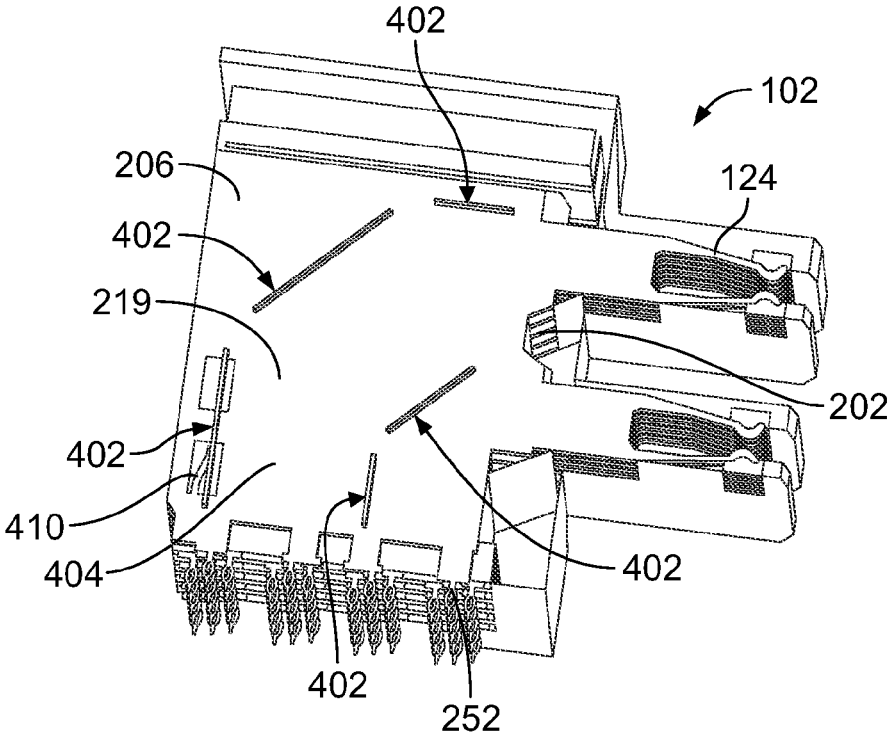
FIG. 4 is a cross-section of an electrical connector in accordance with an embodiment.

FIG. 4 is a cross-section of the electrical connector 102 in accordance with an embodiment. The cross-sectional view in FIG. 4 shows a side-view of one ground plate 206 of the module stack 202. In an embodiment, the ground plate 206 has a conductive body 219 that is formed of metal. For example, the ground plate 206 may be stamped and formed from a sheet of metal. The conductive body 219 of the ground plate 206 may have a single, integral construction, such that the contact beams 124 and mounting pins 252 are integral to, and formed with, the rest of the ground plate 206. In an embodiment, the ground plate 206 does not include any dielectric material, such as over-molding material on the conductive body 219, which allows for tighter packaging of signal modules 204 (shown in FIG. 3) and ground plates 206 within the module stack 202. For example, the ground plates 206 are thinner than the signal modules 204, and reducing the width of the ground plates 206 increases the number of stacked signal modules 204 and ground plates 206 per a unit width of the signal module 202. The conductive body 219 optionally may be solid. In the illustrated embodiment, however, the conductive body 219 includes multiple slots 402 defined through the body 219 between planar sides 404 of the body 219. The slots 402 may be configured to receive ground tie bars 406 (shown in FIG. 2) therethrough. The ground tie bars 406 may be conductive strips of metal that are designed to provide shielding and/or a reference ground plane between the transition portions 302 (shown in FIG. 3) of the signal conductors 214 within the signal modules 204.

Referring now back to FIG. 3, the dielectric body 212 of the signal modules 204 may also define slots 408 that extend through the body 212. The slots 408 may be oriented generally parallel to the path of the transition portions 302 between the contact beams 124 and the mounting pins 252. In the illustrated embodiment, at least some of the slots 408 are disposed between adjacent signal conductors 214 within the dielectric body 212. The slots 408 through the signal modules 204 are configured to align with the slots 402 through the ground plates 206 when the signal modules 204 and ground plates 206 are arranged in the module stack 202.

Referring now back to FIG. 2, the ground tie bars 406 are loaded through the slots 402, 408 (shown in FIGS. 4 and 3, respectively) at least partially across the width 226 of the module stack 202. In an embodiment, the ground plates 206 are configured to mechanically and electrically connect to the ground tie bars 406. For example, the slots 402 of the ground plates 206 may be sized and shaped to provide an interference fit to the ground tie bars 406. Alternatively, or in addition, the ground plates 206 may include a deflectable retention latch 410 (shown in FIG. 4) or tab associated with one or more slots 402 that is configured to retain connection with the corresponding ground tie bar 406.

The ground tie bars 406 extend transversely through the slots 402, 408 (shown in FIGS. 4 and 3, respectively) of the module stack 202 across the contact planes formed by the signal conductors 214 in each signal module 204. The ground tie bars 406 provide shielding to reduce cross-talk and/or interference between signal conductors 214 along the transition portions 302 (shown in FIG. 3). The ground tie bars 406 further provide a reference ground plane behind and/or in front of the signal conductors 214. The reference ground plane provided by the tie bars 406 is transverse to the ground planes provided by the conductive bodies 219 of the ground plates 206 to the sides of the signal conductors 214. Furthermore, since the ground plates 206 may be configured to mechanically and electrically connect to the ground tie bars 406, the ground tie bars 406 electrically tie all of the ground plates 206 in the module stack 202 together to form a common or continuous ground across the width 226 of the module stack 202.

In an alternative embodiment, the ground tie bars 406 may be integral to the ground plates 206, such as tabs that are stamped and bent out of plane of the conductive body 219 of one or more ground plates 206. The integral ground tie bars 406 may still be configured to extend through contact planes of the signal modules 204 and mechanically engage adjacent ground plates 206 to electrically common the ground plates 206 across the module stack 202.

Figure 5:
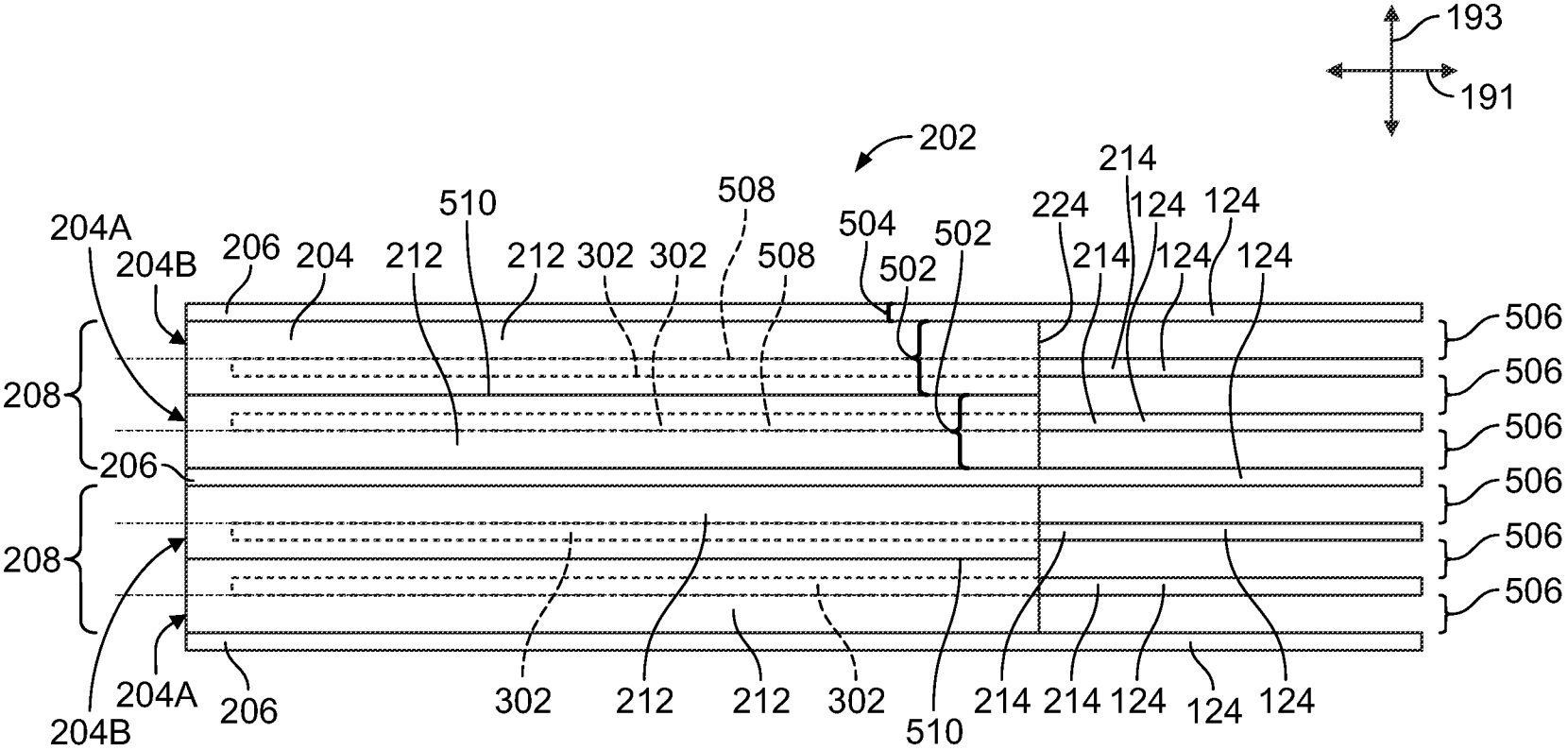
FIG. 5 is a top down view of a module stack of an electrical connector according to an embodiment.

FIG. 5 is a top down view of the module stack 202 of the electrical connector 102 (shown in FIG. 1) according to an embodiment. FIG. 5 may illustrate a portion of the module stack 202 shown in FIG. 2. For example, the module stack 202 shown in FIG. 5 includes two pairs 208 of signal modules 204 and three flanking ground plates 206, which is fewer than the number of signal modules 204 and ground plates 206 shown in FIG. 2, in order to provide greater detail of the illustrated components. The contact beams 124 of the ground plates 206 and signal modules 204 extend forward along the mating axis 191 from the front edge 224 of the module stack 202. Each of the pairs 208 of signal modules 204 includes a left signal module 204A and a right signal module 204B adjacent each other along the lateral axis 193. The left signal module 204A abuts the right signal module 204B at an interface 510. The transition portions 302 of the signal conductors 214 within the respective dielectric bodies 212 of the signal modules 204 are shown in phantom in FIG. 5.

In order to reduce the contact spacing between contact beams 124 in the electrical connector 102 (shown in FIG. 1) and thereby increase the contact density of the electrical connector 102, the width of the signal modules 204 and/or ground plates 206 may be reduced. However, decreasing the width of each signal module 204 is difficult because the dielectric body 212 must be sufficiently thick to provide adequate structural support and electrical isolation of the signal conductors 214 therein. As shown in FIG. 5, the signal modules 204 have a width (e.g., lateral thickness) 502 that sufficient to support and provide isolation to the signal conductors 214. The ground plates 206 have a width or lateral thickness 504 that is less than the width or lateral thickness 502 of the signal modules 204 in order to increase contact density as the ground plates 206 are not over-molded or used to support the signal conductors 214.

In an embodiment, contact spacings 506 between adjacent contact beams 124 across the module stack 202 are uniform. The contact spacing 506 is the distance between adjacent contact beams 124 along the lateral axis 193, such as adjacent contact beams 124 in the same upper or lower row 228, 230 (shown in FIG. 2). The contact spacing 506 includes the spaces between two adjacent contact beams 124 of a pair 208 of signal modules 204 and the spaces between the contact beams 124 of the signal modules 204 and the contact beams 124 of the adjacent ground plates 206. The contact spacing 506 may be established to match a corresponding contact pad spacing on the mating circuit board 126 (shown in FIG. 1) of the pluggable module 106 (shown in FIG. 1). The contact spacing 506 optionally may conform to an industry standard. In one embodiment, the contact spacing 506 may be set to a value that is less than 0.85 millimeters. For example, the contact spacing 506 may be approximately 0.5 millimeters.

In an embodiment, the signal conductors 214 may be planar (for example, extending along a common plane) from the contact beams 124 through the transition portions 302 through the dielectric bodies 212. In order to establish uniform contact spacing 506 despite the signal modules 204 being wider or thicker than the ground plates 206, the signal conductors 214 of each signal module 204 may be offset relative to a central plane 508 of the respective signal module 204. The central plane 508 bisects the signal module 204 along the mating axis 191. For example, the signal conductors 214 of the left signal module 204A may be disposed to the right of the central plane of the left signal module 204A. Inversely, the signal conductors 214 of the right signal module 204B may be disposed to the left of the central plane of the right signal module 204B. As such, the transition portions 302 of the signal conductors 214 within each pair 208 of signal modules 204 may be offset to be positioned closer to each other than if the signal conductors 214 were aligned along the respective central planes 508. For example, in order to establish a uniform contact spacing 506 of 0.5 mm, the width of the dielectric body 212 of the left and right signal modules 204A, 204B between the signal conductors 214 and the abutting ground plates 206 to the left of the left signal module 204A and to the right of the right signal module 204B, respectively, may be 0.5 mm. The width of the dielectric body 212 of each of the left and right signal modules 204A, 204B between the signal conductors 214 and the interface 510 between the signal modules 204A, 204B may be 0.25 mm, however, in order to establish a combined contact spacing 506 of 0.5 mm across the pair 208. The signal modules 204 may be manufactured with signal conductors 214 offset relative to the dielectric body 212, such as during a stamping and forming process or an over-molding process.

In an alternative embodiment, the transition portions 302 of the signal conductors 214 may be aligned with the central plane 508 of each signal module 204, and the contact beam 124 of each signal module 204 within a pair 508 of signal modules 204 is stepped toward the adjacent signal contact beam 124 to provide the uniform contact spacing 506.

Figure 6:
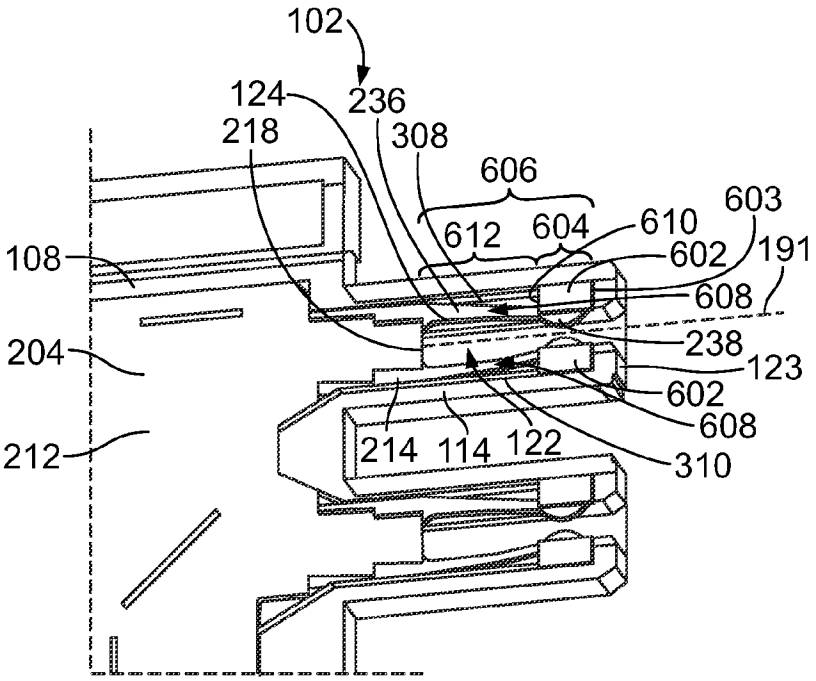
FIG. 6 is a cross-section of a portion of the electrical connector shown in FIG. 3.

FIG. 6 is a cross-section of a portion of the electrical connector 102 shown in FIG. 3. The portion of the electrical connector 102 shows a side view of a signal module 204 within the connector housing 108. In an embodiment, the housing 108 includes divider walls 602 along the interior of the mating interface 114 that are configured to extend between laterally adjacent contact beams 124 to provide separation. For example, the divider walls 602 may be located within the mating cavity 122 proximate to the distal end 123 of the mating interface 114. As shown in FIG. 6, the divider walls 602 are disposed along both the upper and lower interior walls 308, 310 defining the mating cavity 122 of each mating interface 114.

The divider walls 602 may be formed of a dielectric material, like the connector housing 108. Optionally, the divider walls 602 may be integral to the housing 108 and formed of the same dielectric material during a common molding process. When the module stack 202 (shown in FIG. 2) is loaded into the housing 108, the divider walls 602 extend into the contact spacing 506 (shown in FIG. 5) between each adjacent contact beam 124. The divider walls 602 mechanically separate the adjacent contact beams 124 by prohibiting two contact beams 124 from making contact, such as while inserting or removing a corresponding internal circuit board 126 (shown in FIG. 1), which could damage the contact beams 124 and/or damage signal transmission by causing a short circuit. In addition, the divider walls 602 may provide electrical insulation between adjacent contact beams 124.

In an exemplary embodiment, the divider walls 602 are projections that extend rearward along the mating axis 191 from a front surface 603 of the mating cavity 122 towards the signal modules 204 (for example, the module stack 202 shown in FIG. 2). The front surface 603 of the mating cavity 122 may be proximate to the distal end 123 of the mating interface 114. The divider walls 602 extend towards the front edge 218 of the dielectric body 212 (for example, the front edge 224 of the module stack 202) for a length 604 that is less than a total length 606 of the contact beams 124. The length 604 extends from the front surface 603 of the mating cavity 122 to a rear 610 of the divider walls 602. Air gaps 608 are formed or defined within the contact spacing 506 (shown in FIG. 5) between the front edge 218 of the dielectric body 212 and a rear 610 of the divider walls 602. The air gaps 608 are open to the rest of the mating cavity 122 such that air within the mating cavity 122 is able to flow into the air gaps 608 between the contact beams 124.

In an embodiment, the divider walls 602 are positioned between corresponding mating tips 238 of adjacent contact beams 124 to provide separation. The air gaps 608 may be positioned between the deflectable arms 236 of adjacent contact beams 124. The length 604 of the divider walls 602 along the mating axis 191 directly affects the length 612 of the air gaps 608 defined by the rear 610 of the divider walls 602. The lengths 604, 612 may be selected based on electrical design characteristics, such as impedance, of the electrical connector 102. For example, reducing the contact spacing 506 (shown in FIG. 5) between the contact beams 124 lowers the impedance of the connector 102, which could be designed to match the impedance of the operating environment. Some known operating environments operate at an impedance of 85 ohms, 92 ohms, or 100 ohms. Among other factors, the material between two adjacent signal conductors 214 has a significant effect on impedance. Air is generally a better dielectric material than plastic due to the lower dielectric constant of air. As such, the air gaps 608 within the contact spacing 506 may raise the impedance of the signal conductor 214 more than if the divider walls 602 extended the entire length 606 of the contact beams 124. In an embodiment, the length 612 of the air gaps 608 is selected to tune the signal conductors 214 to a target impedance. For example, the length 612 of the air gaps 608 may be selected to compensate for the lowered impedance due to the reduced contact spacing 506 in order to achieve the target impedance.

Figure 7:
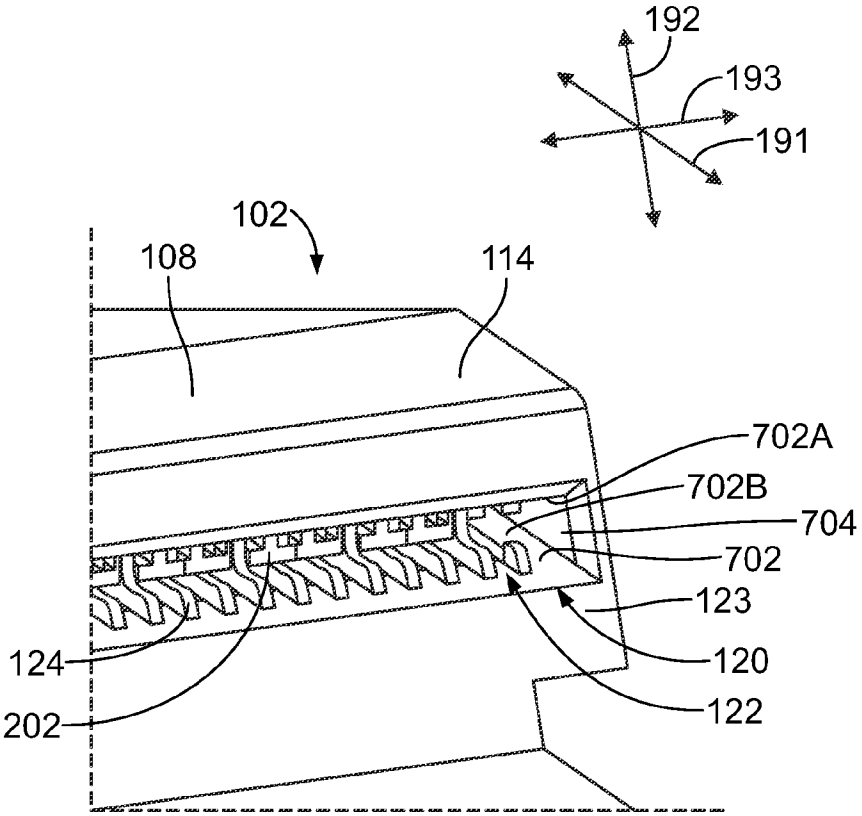
FIG. 7 is a perspective view of a portion of an electrical connector according to an embodiment.

FIG. 7 is a perspective view of a portion of the electrical connector 102 according to an embodiment. The portion of the electrical connector 102 shown in FIG. 7 includes the right side of a mating interface 114. The mating interface 114 may be the first or upper mating interface 114A shown in FIG. 1. In an embodiment, the port 120 and the mating cavity 122 of the mating interface 114 are wider than the width 226 (shown in FIG. 2) of the module stack 202. The housing 108 includes at least one guide rail 702 within the mating cavity 122 between the module stack 202 and an interior side wall 704 of the mating interface 114. The guide rail 702 shown in FIG. 7 is positioned to the right of the module stack 202 along the lateral axis 193. The guide rail 702 extends rearward generally parallel to the mating axis 191 from the distal end 123 of the mating interface 114 into the mating cavity 122. The guide rail 702 is configured to guide the internal circuit board 126 (shown in FIG. 1) of the corresponding pluggable module 106 (FIG. 1) into the mating cavity 122. For example, the guide rail 702 restricts vertical movement and/or tilt of the circuit board 126 as the circuit board 126 is loaded into or removed from the mating cavity 122.

In an embodiment, each mating interface 114 of the housing 108 includes at least one upper guide rail 702A and at least one lower guide rail 702B. The upper guide rail 702A restricts movement and/or tilt of the internal circuit board 126 (shown in FIG. 1) in the upward direction along the elevation axis 192, and the lower guide rail 702B similarly restricts movement and/or tilt in the downward direction. The at least one guide rail 702 may provide a vertical guide mechanism to compensate for the reduced structure within the mating cavity 122 due to the presence of the air gaps 608 (shown in FIG. 6). For example, without walls that extend the length of the contact beams 124, the internal circuit board 126 may be allowed to enter or exit the mating cavity 122 at a detrimental angle or position, which could potentially damage the contact beams 124 and/or the signal quality. In an embodiment, as the internal circuit board 126 is loaded or removed from the mating cavity 122, the circuit board 126 slides along and between the upper and lower guide rails 702A, 702B which restrict the angle and positioning of the circuit board 126 while guiding the circuit board 126 into the mating cavity 122 for electrical connection with the contact beams 124.

The embodiments herein described provide an electrical connector that interconnects a circuit board in a pluggable module to a host circuit board. The connector carries multiple differential data pairs. Ground plates are arranged with pairs of over-molded signal modules in a pattern whereby the differential signal pairs are surrounded by grounds that provide isolation and minimize crosstalk. Contact spacing between contact beams at the mating interface may be narrow. The signal conductors within the signal modules may be planar and offset from a central plane of the signal modules to provide uniform contact spacing. The connector housing includes divider walls between mating tips of adjacent contact beams to separate the beams, while defined air gaps between deflectable arms of the contact beams provide electrical insulation. The length of the air gaps as well as dimensions and materials of the electrical connector are configured to maintain a predetermined impedance through the connector to minimize signal loss.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f) unless and until such claim limitations expressly use the phrase "means for" followed by a statement of function void of further structure.

What is claimed is:

1. An electrical connector comprising:

a housing;

a plurality of signal modules within the housing, the signal modules each having a dielectric body and signal conductors held by the dielectric body, the signal conductors including contact beams protruding from a front edge of the dielectric body for electrical termination; and a plurality of ground plates within the housing arranged in a pattern with the signal modules, the pattern including ground plates flanking corresponding pairs of the signal modules, each ground plate having contact beams laterally aligned with the contact beams of the signal modules to provide shielding therebetween, wherein each signal module has a lateral thickness that is greater than a thickness of each ground plate, the signal conductors within the dielectric body of each signal module being planar and defining a contact plane, the contact plane being offset relative to a central plane that bisects the lateral thickness of the signal module such that contact spacings between laterally adjacent contact beams are uniform.

2. The electrical connector of claim 1, wherein each ground plate includes a conductive body that abuts a side of at least one adjacent signal module.

3. The electrical connector of claim 1, wherein the adjacent contact beams within each pair of signal modules form a differential pair to convey differential signals.

4. The electrical connector of claim 1, wherein each pair of signal modules includes a left signal module abutted against a right signal module, the signal conductors of the left signal module defining a first contact plane that is disposed to the right of the central plane of the left signal module, the signal conductors of the right signal module defining a second contact plane that is disposed to the left of the central plane of the right signal module.

5. The electrical connector of claim 1, wherein the housing has a mating interface that includes a port open to a mating cavity, the mating cavity configured to receive an edge of a mating circuit board of a pluggable module that mates with the mating interface, the contact beams disposed within the mating cavity and configured to electrically connect to the mating circuit board, the housing further including divider walls that extend between laterally adjacent contact beams to separate the adjacent contact beams.

6. The electrical connector of claim 5, wherein the contact beams each have a deflectable arm that extends to a mating tip at a distal end of the contact beam, the divider walls positioned between corresponding mating tips of laterally adjacent contact beams.

7. The electrical connector of claim 6, wherein air gaps are defined between the front edge of the dielectric body of each signal module and a rear of the divider walls, the air gaps being positioned between the deflectable arms of laterally adjacent contact beams.

8. The electrical connector of claim 7, wherein a length of the air gaps between the front edge of the dielectric body and the rear of the divider walls is selected to tune the signal conductors to a target impedance.

9. The electrical connector of claim 5, wherein the divider walls are disposed along both an upper interior wall and a lower interior wall of the mating interface, the signal modules and the ground plates forming a module stack that has a stack width, the port and the mating cavity of the mating interface having a width greater than the stack width, the housing including at least one guide rail within the mating cavity between the module stack and an interior side wall of the mating interface that extends between the upper and lower interior walls, the at least one guide rail configured to guide the mating circuit board of the pluggable module into the mating cavity.

10. The electrical connector of claim 1, wherein the signal conductors of each signal module form a contact plane within the dielectric body, the ground plates include ground tie bars extending transversely through defined slots in the signal module across the contact plane.

11. An electrical connector comprising:

a housing having a front wall and at least one mating interface extending forward from the front wall, each mating interface including a port at a distal end open to a mating cavity, the mating cavity configured to receive an edge of a mating circuit board of a pluggable module therein through the port;

a plurality of signal modules and ground plates in a module stack within the housing, the module stack including a pattern of ground plates flanking corresponding pairs of signal modules, each signal module and ground plate including respective contact beams extending a length from a front edge of the module stack to distal ends of the contact beams, the contact beams of the signal modules and the ground plates being laterally aligned across a width of the module stack in rows, adjacent contact beams in the same row extending parallel to one another and being spaced apart from each other by a contact spacing, each contact spacing being approximately uniform along the length of the two adjacent contact beams that define the corresponding contact spacing, the rows of contact beams disposed within the mating cavity for electrical connection to the mating circuit board, wherein the housing further includes divider walls that are disposed in the contact spacings to separate the adjacent contact beams from each other, the divider walls extending less than the length of the contact beams such that an air gap is defined within each of the contact spacings laterally between the two adjacent contact beams and longitudinally between the front edge of the module stack and a rear of the corresponding divider wall that is located in the contact spacing.

12. The electrical connector of claim 11, wherein the contact beams each have a deflectable arm that extends to a mating tip at a distal end of the contact beam, the divider walls positioned between corresponding mating tips of laterally adjacent contact beams, the air gaps positioned between corresponding deflectable arms of the laterally adjacent contact beams.

13. The electrical connector of claim 11, wherein a length of the air gaps between the front edge of the module stack and the rear of the divider walls is selected to tune the contact beams to a target impedance.

14. The electrical connector of claim 11, wherein the contact beams of each signal module are segments of signal conductors that are held by a dielectric body, wherein each signal module has a lateral thickness that is greater than a thickness of each ground plate, the signal conductors within the dielectric body of each signal module being planar and defining a contact plane, the contact plane being offset relative to a central plane that bisects the lateral thickness of the respective signal module.

15. The electrical connector of claim 14, wherein each pair of signal modules includes a left signal module abutted against a right signal module, the signal conductors of the left signal module defining a first contact plane that is disposed to the right of the central plane of the left signal module, the signal conductors of the right signal module defining a second contact plane that is disposed to the left of the central plane of the right signal module.

16. The electrical connector of claim 11, wherein the divider walls are disposed along both an upper interior wall and a lower interior wall of each mating interface, the port and the mating cavity of each mating interface having a width greater than the width of the module stack, the housing including at least one guide rail within the mating cavity between the module stack and an interior side wall of the respective mating interface that extends between the upper and lower interior walls, the at least one guide rail configured to guide the mating circuit board of the pluggable module into the mating cavity.

17. The electrical connector of claim 16, wherein each mating interface includes at least one upper guide rail and at least one lower guide rail aligned parallel to a mating axis, the at least one upper guide rail and at least one lower guide rail configured to restrict at least one of vertical movement or tilt of the mating circuit board in the upward and downward directions, respectively, as the mating circuit board is loaded into the mating cavity.

18. The electrical connector of claim 11, wherein the contact beams of each signal module are coupled to corresponding signal conductors that form a contact plane within a dielectric body, the electrical connector further comprising ground tie bars extending transversely through defined slots in the module stack across the contact planes of the signal modules.

19. The electrical connector of claim 11, wherein the rows of contact beams are upper rows and lower rows, a set of one upper row and one lower row is received within the mating cavity of each mating interface, the upper row disposed along an upper interior wall of the corresponding mating interface, the lower row disposed along a lower interior wall of the corresponding mating interface, wherein both the upper and lower interior walls include the divider walls to separate laterally adjacent contact beams in each of the upper and lower rows.

20. The electrical connector of claim 11, wherein the module stack has a mounting edge, the signal modules and ground plates including mounting pins that extend from the mounting edge for electrical termination to a host circuit board.

* * * * *